United States Patent [19]

Hager et al.

[11] 4,254,725

[45] Mar. 10, 1981

[54] THREAD-CUTTING DEVICE FOR SEWING MACHINES HAVING A REVOLVING LOOPER

[75] Inventors: Walter Hager, Kaiserslautern; Karl-Heinz Walther, Weilerback, both of Fed. Rep. of Germany

[73] Assignee: Pfaff Industriemaschinen GmbH, Fed. Rep. of Germany

[21] Appl. No.: 144,015

[22] Filed: Apr. 28, 1980

[30] Foreign Application Priority Data

May 3, 1979 [DE] Fed. Rep. of Germany ... 7912758[U]

[51] Int. Cl.[3] ..... D05B 65/02

[52] U.S. Cl. ..... 112/292; 112/301

[58] Field of Search ..... 112/292, 291, 298, 295, 112/301, 300

[56] References Cited

U.S. PATENT DOCUMENTS

| | | | |
|---|---|---|---|
| 3,141,432 | 7/1964 | Reeber et al. | 112/292 |
| 3,173,392 | 3/1965 | Hedegaard | 112/292 |
| 3,782,313 | 1/1974 | Conti | 112/301 |
| 4,202,286 | 5/1980 | Costas | 112/301 X |

*Primary Examiner*—H. Hampton Hunter
*Attorney, Agent, or Firm*—John J. McGlew

[57] ABSTRACT

A thread-cutting device for sewing machines including a housing mounting a reciprocating thread guiding needle which cooperates with a revolving looper comprises a thread catcher adjacent the looper which is movable to engage the thread and to advance the thread past a fixed knife. The catcher is mounted so that it may move relative to the looper and the fixed knife to urge thread held by the catcher into cutting engagement with the knife. Double action fluid pressure operated piston and cylinder is connected to the catcher so as to move it relative to the knife and to the looper. A member is connected to the mechanism between the fluid pressure cylinder operator and the thread catcher and a spring has one end connected to the member and an opposite end mounted on the housing in such a manner that the force of the spring may be adjusted. A fluid pressure operated control has a movable control piston rod which is engageable with the member in an engagement portion thereof such as an opening therethrough. When engaged, it holds the connection between the fluid pressure operated piston rod and the thread catcher against the influence of the spring. When the spring is connected so that it operates through the member moving the catcher, it causes the catcher to be moved during the cutting movement of the thread with some delay so that tearing of the thread is less likely. In a non-operative position, the control member holds the moving mechanism for the thread catcher against the force of the spring.

6 Claims, 2 Drawing Figures

THREAD-CUTTING DEVICE FOR SEWING MACHINES HAVING A REVOLVING LOOPER

BACKGROUND OF THE INVENTION

Field of the Invention

This invention relates, in general, to sewing machines and, in particular, to a new and useful thread cutting device on sewing machines with a revolving looper, including a thread catcher which is actuated by double-action pneumatic cylinder and which executes a movement in one direction simultaneously gripping the needle thread and the looper thread and a movement in the other direction pulling both threads out and supplying them to a fixed knife.

Such thread cutting devices are better suited for the cutting of strong threads than those with mechanical drive by the main shaft of the machine. However, they have the disadvantage that disturbances in the synchronization of the movement of the thread catcher with the movement of the looper due to different influences on the movement sequence as a result of the independent drives of the sewing machine and the thread cutting device cannot be entirely avoided. The thread cutting device therefore does not always work quite satisfactorily; in particular, it has been found that after prolonged down time the cutting device may fail on first use.

SUMMARY OF THE INVENTION

The invention provides a thread cutting device which is an improvement of the known arrangement by simple means to exclude with certainty malfunctions of the cutting device.

The invention shortens the time of the thread-seizing movement of the thread catcher in a sewing machine so as to overcome sluggishness of a piston actuator in starting. According to the innovation, a spring which supports the thread-gripping movement and inhibits the thread-pulling movement engages at the piston rod of the pressure fluid operated cylinder and piston. By this measure not only are irregularities of response of the cylinder compensated, but the thread-pulling movement takes place more slowly, whereby tearing of the threads before the cutting process is avoided.

To be able to vary the degree of control of the movement of the thread catcher by the spring, the spring tension is adjustable. Advantageously the spring engages at one end at a member connected with the piston rod of the pneumatic cylinder and at the other end at an arm of an angle lever which is pivotally fastened to the housing of the sewing machine and whose other arm carries a setting screw taking support against the housing.

In order that the spring will not pull the thread catcher into the needle path upon failure of operating fluid such as air, the piston rod of the pneumatic cylinder is connected with a member which has an opening extending into the path of the piston rod of a single-action pneumatic cylinder.

Accordingly, it is an object of the invention to provide an improved means for advancing a thread catcher in respect to a looper and a fixed knife which includes an operating spring which may be released so that a driving piston rod for the catcher must operate against the force of the spring during a cutting motion and in the nonoperative position, the driving mechanism for the catcher is held in a fixed position against the force of the spring.

A further object of the invention is to provide a device for engaging a thread and moving it into association with a cutter which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENTS

Figure 1:
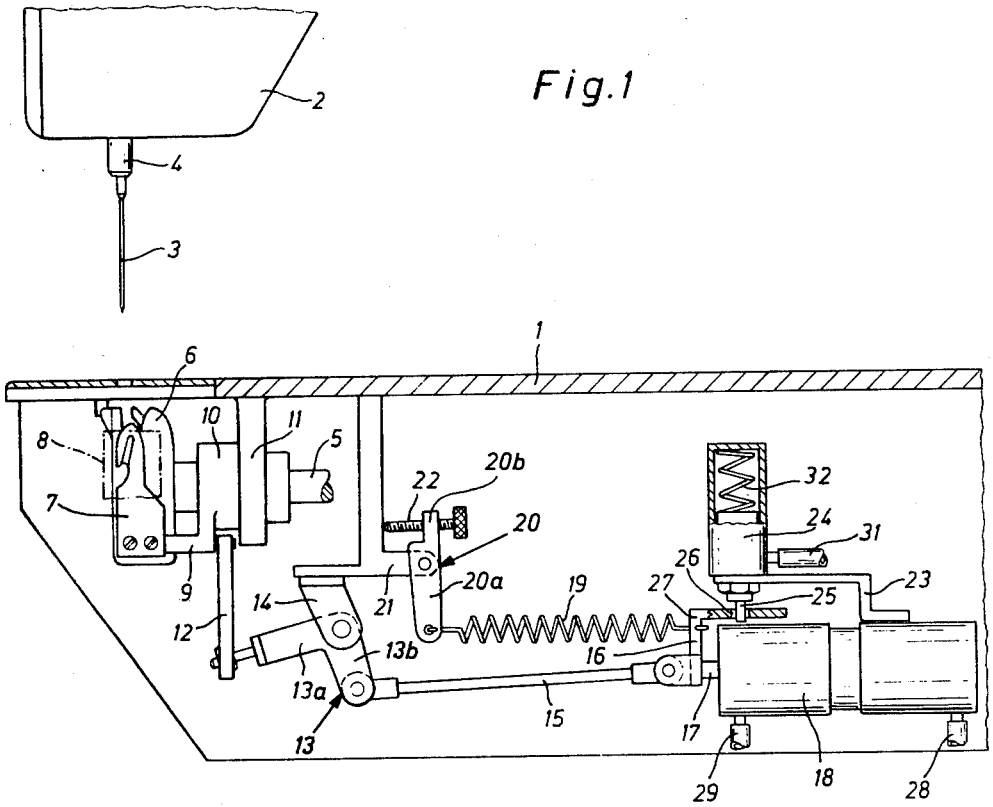
FIG. 1 is a partial, sectional view, partly in elevation, of a sewing machine having a thread-severing mechanism constructed in accordance with the invention.

Referring to the drawings, in particular, the invention embodied therein comprises a thread-cutting device for sewing machines which includes a housing generally designated 50 which includes a base plate portion 1 and a head portion 2 which is mounted over the base plate and which carries a reciprocating needle bar 4 having a thread guide needle 3.

FIG. 1 shows the base plate 1 and head 2 of a sewing machine, in which is mounted the vertically movable needle bar 4 carrying the thread-guiding needle 3. Under the base plate 1, is mounted the horizontal looper drive shaft 5, which carries at its front end the looper 6 cooperating with the needle 3.

Below the base plate, a thread cutting device is provided, whose action and construction are described in detail in U.S. Pat. No. 3,173,392. The thread cutting device comprises a thread catcher 7 which is arranged coaxially with the looper 6 and which cooperates with a cutting knife 8 fastened to the underside of the base plate 1. Thread catcher 7 is fastened on a support arm 9 which is connected with a ring 10 loosely embracing the looper drive shaft 5. The ring 10 is fixed in axial direction but mounted rotationally in a ring track 11 which is secured below the cloth support plate 1. To the support arm 9 is articulated a coupling rod 12 which is connected with an arm 13*a* of an angle lever 13 which is supported by a bearing block or bracket 14 secured to the housing. Another arm 13*b* of the angle lever 13 is connected via a pull rod 15 with a member 16 which is fastened to a piston rod 17 of a double-action pneumatic cylinder 18 secured under the base plate 1.

One end of a strong extension spring 19 is connected to member 16, and the opposite end engages at an arm 20*a* of a lever 20. The lever 20 is mounted on a bearing block 21 which is secured to the housing. On opposite arm 20*b* of lever 20 a setting screw 22 is screwed in, which takes support against the attachment face of the bearing block 21.

Figure 2:
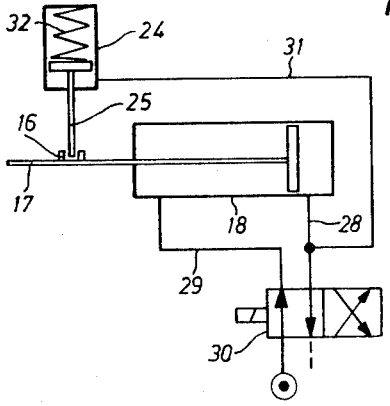
FIG. 2 is a schematic diagram indicating the control structure for operating the thread cutting mechanism.

An actuator cylinder 18 is supported below the base plate 1 and carries a support 23 for a single-action pneumatic cylinder 24 having an actuator piston (not shown) whose piston rod 25 extends in its extracted inoperative state into an opening 26 of a two-angle part 27 of the member 16. As can be seen from FIG. 2, the cylinder 18 is connected by flexible tube lines 28 and 29 with an electromagnetically controllable 4/2-way control valve 30, which by an electric control circuit (not shown) is connected to voltage for actuation of the cutting device in synchronization with the position of the sewing tools. Cylinder 24 is connected to tube line 28 through a tube line 31. In its inoperative position, a spring 32 pushes the piston rod 25 outward.

The device works as follows:

As the machine is switched on, valve 30 is not applied to voltage, so that cylinder 18 is pressurized with compressed air via line 39, but piston rod 17 remains in the position shown in FIG. 1. Cylinder 24 communicates with the outside air via its line 31, so that the engagement of piston rod 25 in the opening 26 of part 27 of the member 16 is maintained.

At the end of a seam, controlled by a known synchronizer not shown, the machine stops in the upper dead center position of the needle 3. The thread cutting device is thereafter activated for example by backward operation of the foot rocker. At that, the machine executes one revolution. During this revolution, the electro-magnetically controlled 4/2-way valve 30 is applied to voltage, for instance in the lower dead center position of the needle 3, by the synchronizer, so that it reverses and cylinder 24 is pressurized with compressed air via line 31 and piston rod 25 is pushed into cylinder 24. Piston rod 25 thus releases member 16, so that piston rod 17 simultaneously pressurized via line 28 is pushed out of cylinder 18, with support of spring 19. Due to the smaller filled volume of the cylinder 24, in respect to the cylinder 18, the piston rod 25 responds faster than the piston rod 17 and released member 16 before the wall of opening 26 applies against piston rod 25. By the action of spring 19, the retaining friction of the piston wall applying against cylinder 18 is overcome faster and slip-stick effects between piston and cylinder are compensated.

In its movement to the left, the piston rod 17 swings the thread catcher 7, by the movement of the pull rod 15, angle lever 13 and coupling rod 12, into the thread loop seized and spread out by looper 6 and grips, in a known manner, the leg of the needle thread loop leading to the work together with the looper thread leading to the work.

After the machine has been stopped in the upper dead center position of the needle 3, the current to valve 30 is cut off via a time-delay member, and the valve reverses to its inoperative position again, so that cylinder 24 is vented and its piston rod 25 places itself on part 27 under the action of spring 32. Simultaneously, also the right side of cylinder 18 is vented and the left side pressurized with air; piston rod 17 moves into the cylinder 18 and, by movement of the angle lever 13 and coupling rod 12, pivots the thread catcher 7 against the cutting knife 8 into the cutting and inoperative position. Meanwhile, the hook at the thread catcher 7 pulls thread from the needle and looper thread supply according to the length of its movement before it sends the threads to the cutting knife 8, at which they are severed.

In the cutting movement, cylinder 18 must work against the resistance force of spring 19, so that this movement proceeds with delay, and possible tearing of thread before the cutting of the threads is avoided.

In the end position of piston rod 17 of cylinder 18, piston rod 25 of cylinder 24 drops into the opening in part 27 coming under it, so that the thread catcher 7 then maintains its inoperative position also counter to the force of spring 19 as the compressed air is turned off.

While a specific embodiment of the invention has been shown and described in detail to illustrate the application of the principles of the invention, it will be understood that the invention may be embodied otherwise without departing from such principles.

What is claimed is:

1. A thread cutting device for sewing machines including a housing mounting a reciprocating thread guide needle which cooperates with a revolving looper, comprising a thread catcher mounted in said housing adjacent the looper, a fixed knife mounted in the housing adjacent the looper, mounting means in said housing mounting said catcher for movement relative to the looper and to said knife, said catcher being engageable with the thread to move the thread into cutting engagement with said knife, a double action fluid pressure operated piston and cylinder connected to said mounting means for moving said catcher including a piston rod which is movable, a member connected to said piston rod and being movable therewith and having an engagement portion, a spring having one end connected to the housing and having an opposite end connected to said member, a fluid pressure operated control having a movable control piston rod engageable with said engagement portion to hold it in a fixed position against the force of said spring and to release it so that said member is under the influence of said spring, said fluid pressure operated piston and cylinder piston rod during the movement of said catcher working against the force of said spring so that this movement proceeds with delay, said control piston rod, when engaged with said engagement portion holding said catcher in an inoperative postion against the force of said spring when said fluid pressure operated piston and cylinder is not actuated.

2. A thread cutting device according to claim 1, including means for adjusting the tension of said spring.

3. A thread cutting device according to claim 1, wherein said member has an opening therethrough defining said engagement portion, said control piston rod being engageable through the opening, each of said fluid-pressure operated control and said fluid-pressure operated piston and cylinder being pneumatically operated.

4. A thread cutting device according to claim 2, including a lever member mounted on said housing and having one end connected to said spring and having an opposite end, an adjustment means carried by said opposite end and bearing against said housing for varying the force of said spring.

5. A thread cutting device according to claim 1, including a driving mechanism connected between said thread catcher and said fluid pressure operated piston and cylinder piston rod, said member comprising an angle member connected to said fluid pressure operated piston rod and having an angle portion having an opening therethrough defining said engagement portion, said control piston rod being extendable through the opening of said engagement portion, said fluid pressure operated control comprising a cylinder housing of a smaller diameter than the cylinder housing of said fluid pressure operated piston and cylinder so that it is operated by fluid faster than said cylinder and control valve means connected between said control cylinder and said fluid pressure operated piston and cylinder.

6. A thread-cutting device according to claim 4, including a lever mounted in said housing adjacent said member, said lever member having a first arm portion engageable with said spring and an opposite arm portion and means for adjusting the position of said opposite arm portion and thus said first arm portion to vary the tension on said spring, said spring being connected at its end opposite lever first arm portion to said member.

* * * * *